US006164397A

United States Patent [19]

Appleton et al.

[11] Patent Number: 6,164,397

[45] Date of Patent: Dec. 26, 2000

[54] VEHICLE FOR TRAVERSING EXTERNAL CURVED SURFACES

[76] Inventors: Ernest Appleton, 9, Dunelm Court, South Street, Durham DH1 4QX; Neil William Stutchbury, 8 Glencourse, East Boldon, Tyne & Wear NE36 0LW, both of United Kingdom

[21] Appl. No.: 09/190,045

[22] Filed: Nov. 10, 1998

[30] Foreign Application Priority Data

Nov. 12, 1997 [GB] United Kingdom ..... 9723779

[51] Int. Cl.[7] ..... B62D 57/00

[52] U.S. Cl. ..... 180/7.1; 254/264

[58] Field of Search ..... 180/7.1, 8.1, 8.4, 180/8.7; 104/112; 254/264

[56] References Cited

U.S. PATENT DOCUMENTS 4,615,509 10/1986 Biass ..... 254/264
4,712,772 12/1987 Negrutsky et al. ..... 254/264
4,919,223 4/1990 Egger et al. ..... 180/8.1
5,788,002 8/1998 Richter ..... 180/8.5

FOREIGN PATENT DOCUMENTS 2 305 407 4/1997 United Kingdom .

*Primary Examiner*—Kevin Hurley
*Attorney, Agent, or Firm*—Rodman & Rodman

[57] ABSTRACT

A vehicle, designed to move across an external curved surface such as that of a pipe or cable, for example to monitor the condition of the surface or enable the application of a treatment to the surface, comprises two generally hollow bodies, interconnected by means to move the bodies towards and away from each other, each body having generally parallel, generally flat resilient members each having a generally central aperture, which apertures are in general alignment.

15 Claims, 5 Drawing Sheets

VEHICLE FOR TRAVERSING EXTERNAL CURVED SURFACES

The present invention is a vehicle devised for traversing external curved surfaces, for example of pipes, electricity cables or bracing cables, for such purposes as monitoring the condition of the surface or applying a treatment to the surface.

Surface traversing vehicles for carrying out inspection of the internal surfaces of pipes or other conduits, for example of pipes for conveying water, sewage or other public utility services, are known. In Patent Specification GB 2305407A we have described such a vehicle which comprises two or more bodies each supported upon a multiplicity of resilient bristles. That prior vehicle is very effective when used upon interior pipe surfaces and may also be used upon the curved outer surfaces of chimneys, posts, cables or the like. However, the monitoring of such outer surfaces does entail difficulties not encountered with internal pipe surfaces, in particular when the diameter of the outer surface is relatively small. For example, whatever prior means is used to support the vehicle, the convex outer surface tends to cause the surface gripping feature of the vehicle to spread, for example bristles to splay outwardly, thereby reducing the gripping, and in turn the potential load-carrying capacity, of the vehicle. This problem is of course made more difficult if the surface is of small diameter, for example that of a support cable.

It is therefore an object of the present invention to provide a vehicle for traversing such external curved surfaces, by means of which some at least of such difficulties of prior surface traversing vehicles are reduced or overcome.

The surface-traversing vehicle according to the present invention comprises two generally hollow bodies interconnected by means to move the bodies towards and away from each other, each said body having a plurality of generally parallel, generally flat resilient members extending across the interior of the body, each said resilient member having an aperture within the region of the centre thereof, the apertures within each body being in general alignment.

Surprisingly, we have established that when the vehicle of the present invention is mounted around an elongate convex surface such as that of a cable, with the cable extending through the aligned apertures of the resilient members within the two bodies, and when the outer diameter of the convex surface is a little greater than the un-tensioned diameter of the apertures, reciprocal movement of the bodies towards and away from each other causes the vehicle to progress along the cable.

The two generally hollow bodies are preferably rotationally symmetrical, externally and/or internally, but may be of other shapes if desired. Preferably they are of generally cylindrical form. Means are provided between the bodies which connect the two bodies together and by which relative movement of the bodies towards and away from each other may be effected. Such means may be electrically operated, for example by an electrical line from a separate source or from a battery, but it is particularly preferred that these interconnecting means take the form of one or more pneumatic cylinders, or less preferably hydraulic cylinders, by which the bodies are moved towards and away from each other in accordance with the direction of flow of the cylinder operating fluid.

When the means interconnecting the two bodies are pneumatic or hydraulic cylinders, it is highly desirable that such cylinders be disposed symmetrically around the axis of the bodies, in order to apply a balanced force between the bodies. To that end, it is preferred to employ at least three such cylinders, disposed at equal angular intervals around the peripheries of the bodies.

While the vehicle of the present invention may comprise just two hollow bodies, additional such bodies may be used, for example in order to increase the working load of instruments or other equipment to be carried by the vehicle or to extend its operating length. When the vehicle comprises only two hollow bodies, it may be desired to interconnect them in a manner which permits no lateral relative movement, for example pivoting, especially when only surfaces which are linear in the direction of movement of the vehicle are concerned. However, it is in general preferred that the bodies be flexibly interconnected, in particular to enable the vehicle to traverse non-linear paths, for example having curves or angles.

The resilient members extending across the interior of each of the bodies form the means by which the bodies grip the surface being traversed. The peripheral shape of each resilient member may be generally disc-shaped when the hollow body is correspondingly of circular cross-section. In one preferred form of the present invention, the resilient members are of natural or synthetic rubber or other polymeric material. Preferably such relatively flexible members of rubber or the like are supported by being interleaved with other members of greater rigidity. Such other members may be of a more rigid synthetic polymeric material or of a metal, for example of steel or especially of phosphor bronze. As one alternative to the use of such supported rubber or polymeric members, the resilient members may themselves be of a resilient metal, for example of a spring steel or of phosphor bronze.

The aperture at the centre of each generally flat resilient member is formed with a slightly smaller cross-section than that of the convex surface to be monitored, so that the cable or other article having the convex surface may be gripped within the aperture. When the resilient member is readily distortable by stretching, for example when it is of rubber, then the article may thereby be passed through the aperture. However, if the resilient member is of metal, then it is much preferred to provide one or more radial slots, extending outwardly from the aperture, to permit resilient flexing of the member so that it may encircle the article under examination.

In one preferred form of the invention, the resilient members are of a rubber or polymeric material and these members are spaced apart by other, more rigid, members of which the central apertures are of slightly larger cross-section than the apertures in the resilient members. Distortion of the resilient members to accommodate the article under examination may then entail the material of the resilient member, in the region of the central aperture, projecting into the aperture of the more rigid member and as a result engaging the convex article more closely. In one alternative preferred form of the present invention, the resilient members, of rubber or other polymeric material, are supported between spacers with central apertures which taper in one axial direction, thereby allowing the material of the resilient member around its aperture to project into, and frictionally engage, the tapered aperture of the adjacent spacer.

The hollow bodies surround the convex surface, and advance along it, when the vehicle is in use. Thus the article having the surface under examination or treatment must extend through the aligned central apertures in the resilient members. For this purpose, if the article has a free end, the latter end is introduced at one end of the vehicle and passed through the successive central apertures of each hollow body in turn. However, as a preferred alternative, each hollow body may be designed to swing open along a peripheral line, for example a hinge, generally parallel to the length of the body. As a further alternative, each body may be formed with a peripheral linear slot through which the article under examination may be introduced. As yet another alternative, when the article in question is, say, an exposed cable, for example an underwater or above-water support cable for an off-shore installation, in particular one requiring frequent inspection, the cable-traversing vehicle may be dedicated to monitoring that specific cable only and may be left in position on the cable.

While the power for driving the surface-traversing vehicle of the present invention may be self-contained, that is the vehicle may itself carry electrical batteries by which the advancing mechanism is powered, in general it is convenient to provide the necessary power via a pneumatic or hydraulic line. If the distance of operation of the vehicle is significant, or if the power line represents a significant part of the vehicle load, one or more additional hollow bodies may be provided to assist the towing of the power line or an additional traversing vehicle may be employed.

In particular when the vehicle comprises more than two hollow bodies, it is of course important that the relative movement of the bodies, by which the vehicle is caused to advance over the curved surface, be effected in the correct sequence. To this end, the operation of the pneumatic cylinders or other driving means may advantageously be effected by means of a suitable controller, in turn programmed to control the various operations of the vehicle. Such a controller may be carried by the vehicle or remote from it, for example operating the vehicle via a radio link.

Provision is preferably made for operating the vehicle in reverse. To this end, the direction of orientation of the grip of the resilient members upon the surface is required to be reversed. For example, this may be achieved by the provision of means for at least one of the bodies, or the vehicle overall, to grip the surface so that the movement of the other body in a reverse direction will cause the orientation of the resilient members of that body to be reversed, in the region surrounding the central apertures. In the case where the natural grip of the resilient member has been enhanced in one direction, for example by the provision of a backing plate, the vehicle may include means for retracting the backing plate, either bodily or by operation of an iris aperture mechanism.

While, depending upon the specific design of the vehicle, including the material of the resilient members and the load which it is intended to carry, the vehicle may be self supporting, additional support may be provided in the form of one or more wheels or runners engaging the curved surface; for example such wheels may be arranged in groups of 2, 3 or 4 wheels, distributed symmetrically about the main axis of the vehicle.

The surface-traversing vehicle according to the present invention may be used in a wide range of situations in which it is desired to monitor the condition of the convex outer surface of an elongate article or to apply a treatment to such a surface. By way of example the vehicle may be designed to travel along the exterior of a service conduit, for example to monitor the condition of its surface or of joints or, for example by electromagnetic methods, to monitor the interior of a conduit. The vehicle may be used to travel vertically over the length of a chimney. The vehicle is further of particular value for monitoring cables, for example electrical supply cables such as suspended overhead cables or bracing cables acting as stays for large structures, including off-shore structures.

The invention will now be further described, by way of example only, with reference to the accompanying drawings, which illustrate various embodiments of the surface-traversing vehicle according to the present invention and wherein.

Figure 1:
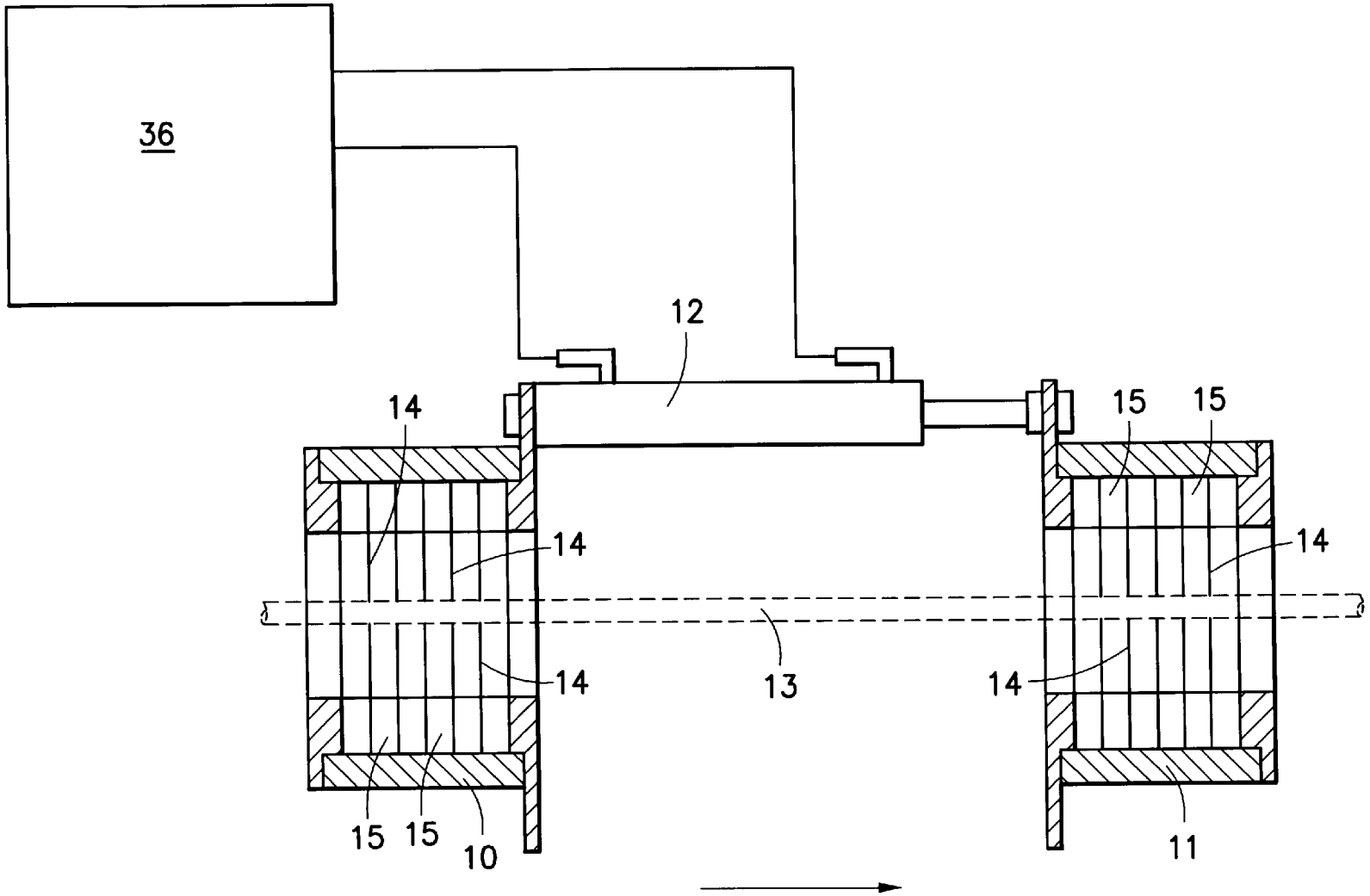
FIG. 1 is a vertical cross-sectional view along the axis of a first embodiment of the vehicle.
Figure 3:
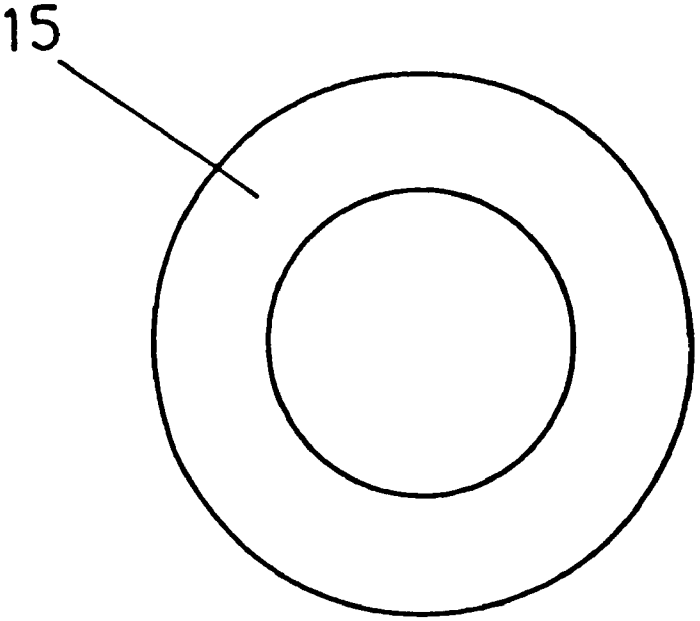
FIGS. 2 and 3 are elevations respectively of a resilient member and a spacer of the vehicle of FIG. 1.
Figure 2:
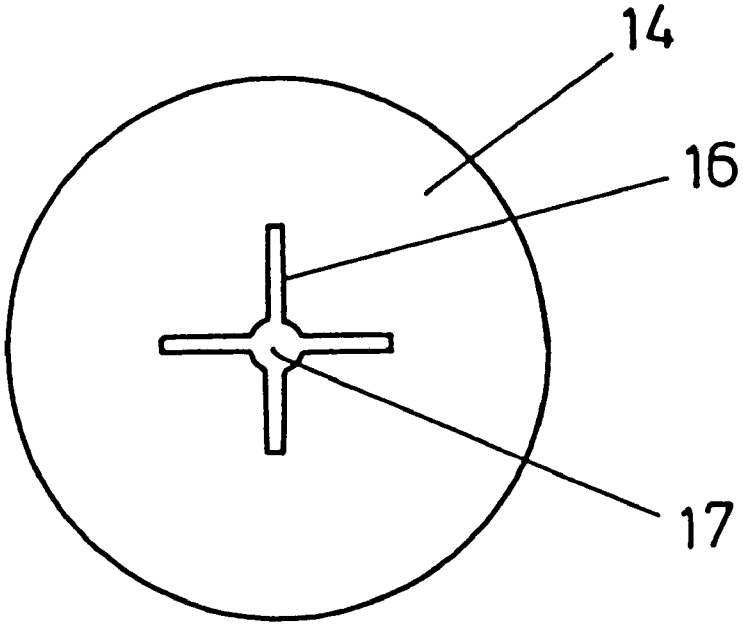

The surface traversing vehicle illustrated in FIGS. 1 to 3 comprises two hollow cylindrical steel bodies 10, 11, axially aligned and connected together by pneumatic cylinders 12. Only one such cylinder is shown in the drawings for the sake of clarity but there are three such pneumatic cylinders interlinking the steel bodies, the cylinders being connected at 120-degree intervals around the periphery of the bodies 10, 11. The vehicle surrounds a shaft of which it is intended to monitor the surface and which is indicated in broken line at 13.

Within each of the bodies 10, 11 is assembled a sequence of alternating flexible members 14 of phosphor bronze and spacers 15 of synthetic polymeric material. These flexible members and spacers are seen from the front in FIGS. 2 and 3 respectively. The flexible members 14 are each formed with four radial slots 16, distributed uniformly around a small central aperture 17.

The diameter of the aperture 17 is slightly less than the diameter of the shaft 13 so that, when the shaft is inserted through this aperture, the parts of the member 14 between the slots 16 must flex slightly to allow passage of the shaft. In this way, the members 14 grip the shaft 13, in a directional manner reflecting the direction of insertion of the shaft. Since the shaft is inserted in the same spatial direction through the two bodies 10, 11, the bodies will both grip the shaft better in a given common direction than in the reverse direction.

Thus when the cylinders 12 are expanded, the rearward body (say body 10) grips the shaft and allows the cylinders to push body 11 forward along the shaft, against the lesser resistance in that direction of the members 14 in that body. When the cylinders are subsequently retracted, the forward body 11 resists rearward movement along the shaft and the body 10 is thereby pulled forwardly. Thus alternate expansion and contraction of the cylinders 12 causes the bodies 10 and 11 to advance in turn along the shaft 13. Any suitable known control means for controlling the expansion and contraction of the cylinders 12 is generally indicated in schematic form by reference number 36.

Figure 4:
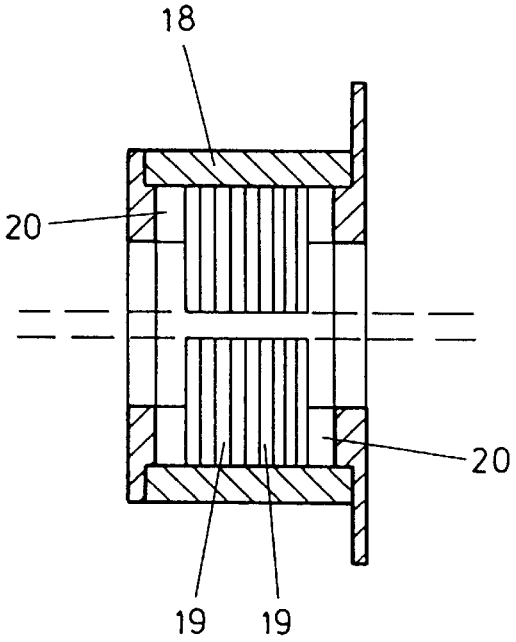
FIG. 4 is a sectional view of one of the hollow bodies of FIG. 1, containing an alternative form of resilient members and spacers.

FIG. 4 shows a hollow body 18 containing an assemblage of rubber flexible members 19 confined between spacers 20.

The gripping of the shaft in this case is provided by simple expansion of the central apertures in the rubber members 19 around the shaft.

Figure 5:
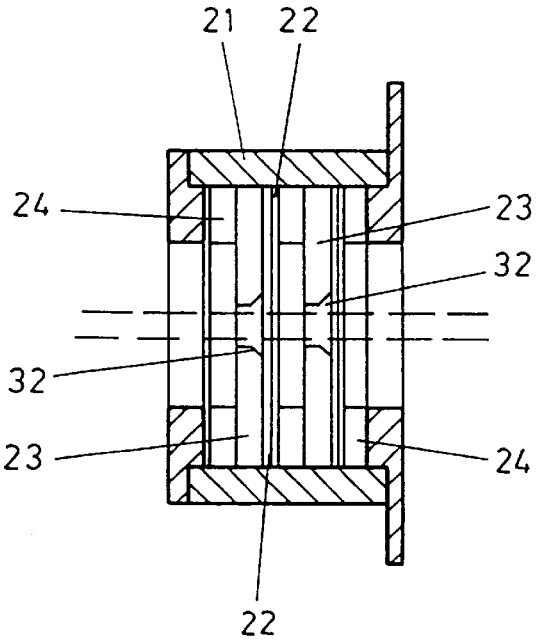
FIG. 5 is a view corresponding to FIG. 4, showing a further alternative form of resilient members and spacers.

The hollow body 21 illustrated in FIG. 5 contains thin rubber flexible members 22 supported against rigid discs 23 between rigid spacers 24. The discs 23 have central apertures 32 which are slightly larger than the central apertures of the discs 22. The apertures 32 taper markedly in one direction as illustrated and thereby allow the rubber surrounding the shaft to enter the apertures 32 and thus to grip the shaft more tightly in that direction than in the opposite direction.

Figure 6:
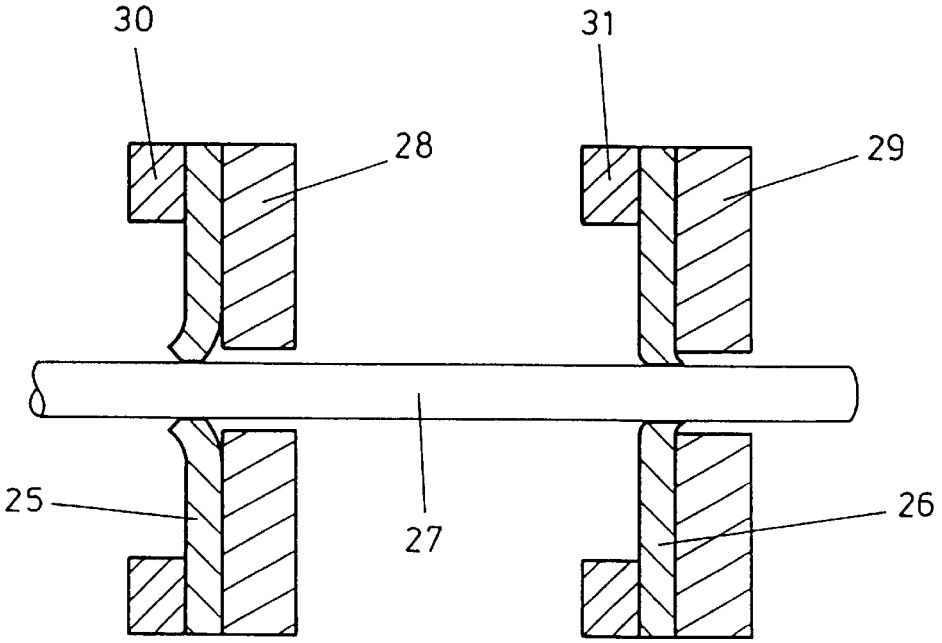
FIG. 6 is a sectional view showing, to a somewhat larger scale, yet a further form of resilient member and spacer and illustrating how they engage a shaft.

Referring finally to FIG. 6, two flexible members 25, 26 are illustrated gripping a shaft 27. Each flexible member is retained against a circular back-plate (28 or 29) by a spacer (30 or 31). When the two flexible members are drawn towards each other by pneumatic cylinders or other means (not shown), the member 26 is forced by friction into the central aperture of the plate 29 as shown and thereby grips the shaft 27 tightly. However the pull on the member 25 allows it to distort away from the shaft and in that way grip the shaft 27 less tightly than does the member 26. As a result, the member 25 is drawn towards the member 26. However, when the cylinders are expanded to force the two flexible members apart, the member 25 is forced into the central aperture of the plate 28, while the flexible member 26 reverses its direction of distortion and reduces its grip on the shaft. Thus the member 25 now grips the shaft more tightly than the member 26 and the latter member is pushed forward.

In this way, alternate expansion and contraction of the cylinders causes the members 25 and 26 to advance in alternate steps along the shaft 27.

Figure 7:
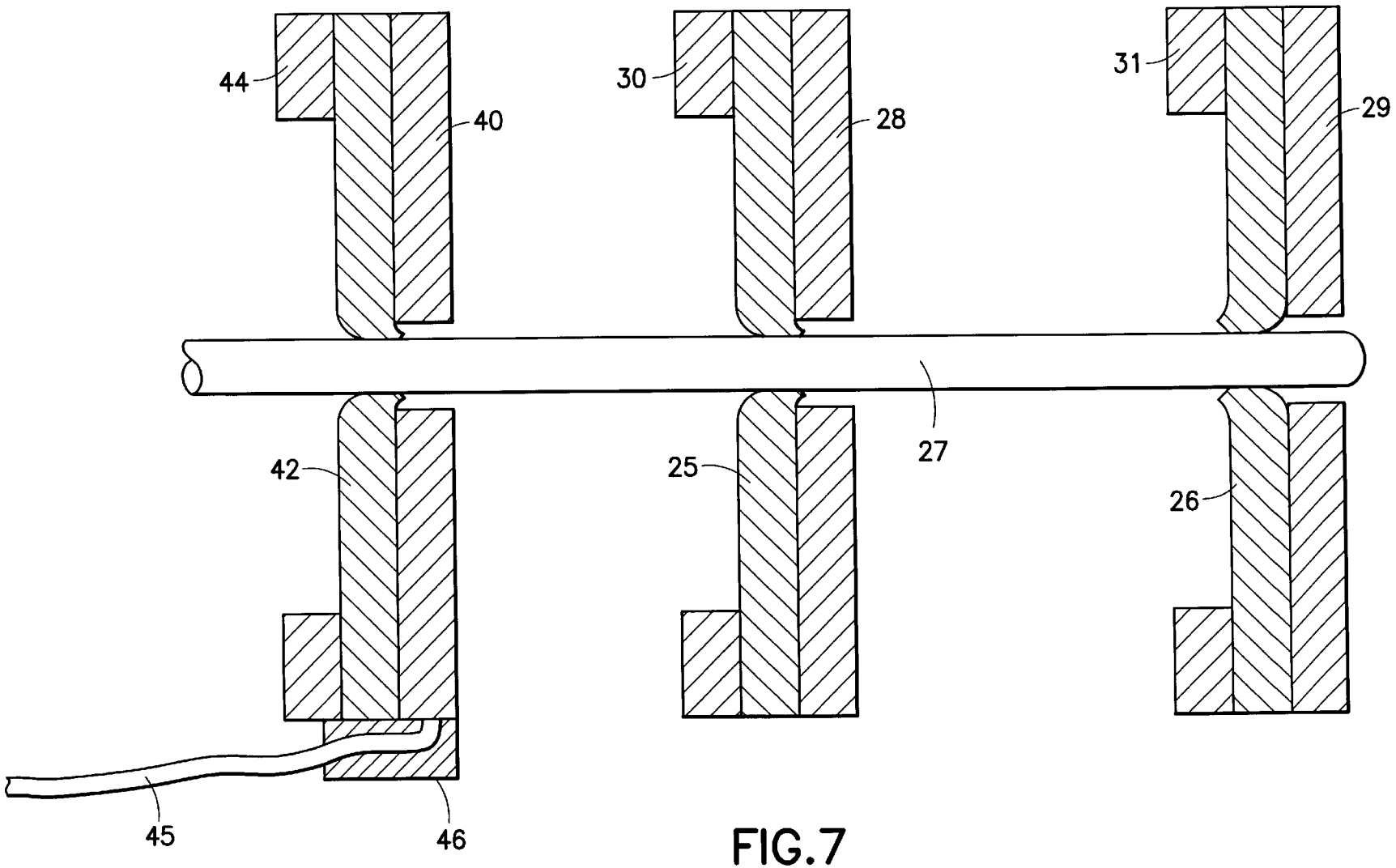
FIG. 7 is a sectional view showing an additional hollow body with a power supply line, the hollow body assisting in the towing of the power supply line for the vehicle; and, FIG. 8 is a vertical cross sectional view along the axis of the first embodiment of the vehicle showing additional support provided by one or more wheels or runners engaging the surface traversed by the vehicle.

FIG. 7, adapted from FIG. 6, shows an additional hollow body including a back plate 40, a flexible member 42 and a spacer 44. The additional hollow body, which is similar to the hollow bodies shown in FIG. 6, is provided to tow a power supply line 45 for the vehicle. The power supply line 45 can be held on the additional hollow body in any suitable known manner such as by use of a suitable known cable clamp shown schematically at reference number 46.

Figure 8:
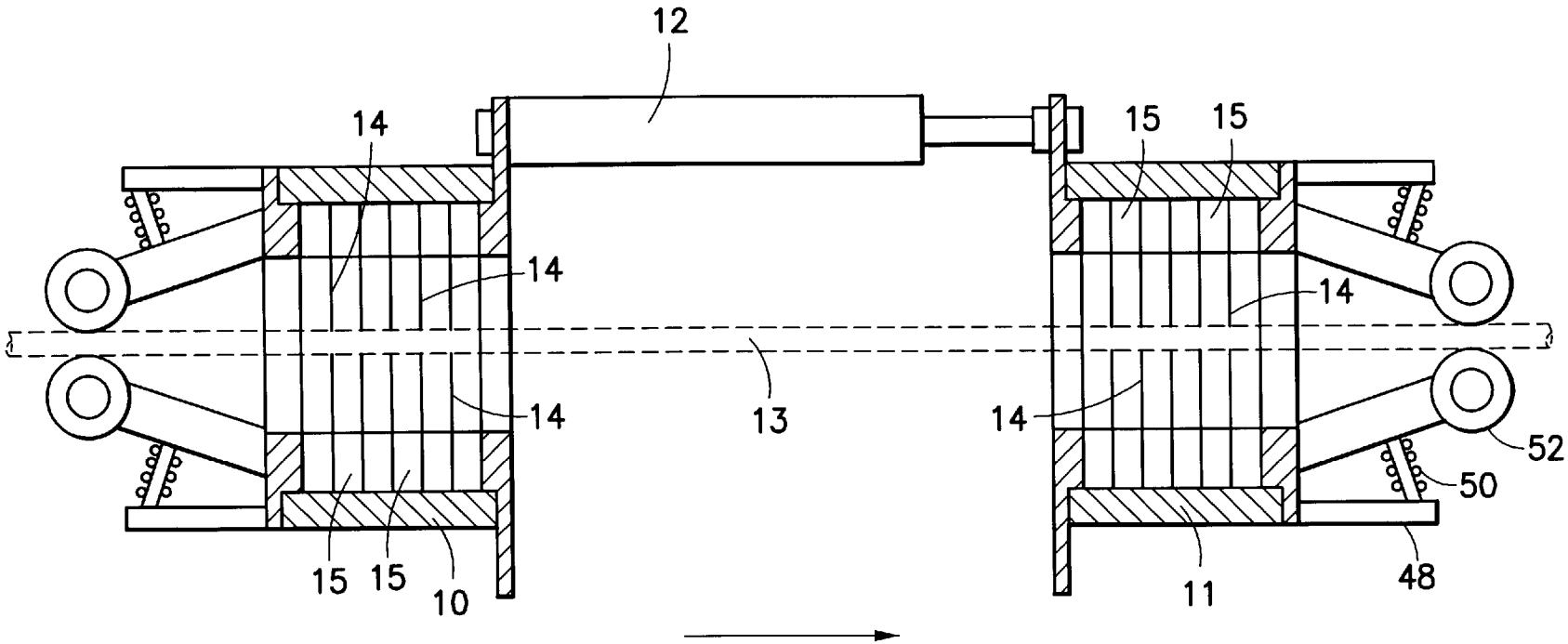

FIG. 8, adapted from FIG. 1, shows additional support for the vehicle in the form of one or more wheels or runners 52 engaging the shaft 13 that is being traversed. The wheels or runners 52 are pivoted to the hollow bodies 10 and 11 in any suitable known manner and are resiliently supported against the shaft 13 by a spring 50 arranged between a support bracket 48 and the wheels or runners 52.

What is claimed is:

1. A surface-traversing vehicle which comprises two generally hollow bodies interconnected by means to move the bodies towards and away from each other, each said body having a plurality of generally parallel, generally flat resilient members extending across the interior of the body, each said resilient member having an aperture within the region of the centre thereof, the apertures within each body being in general alignment.

2. A surface-traversing vehicle according to claim 1, wherein said generally hollow bodies are rotationally symmetrical.

3. A surface-traversing vehicle according to claim 1, wherein said interconnecting means comprise at least one pneumatic or hydraulic cylinder.

4. A surface traversing vehicle according to claim 3, comprising at least a total of three of said pneumatic or hydraulic cylinders disposed symmetrically around the axis of the bodies.

5. A surface-traversing vehicle according to claim 1, wherein said generally hollow bodies are flexibly interconnected.

6. A surface-traversing vehicle which comprises two generally hollow bodies interconnected by means to move the bodies towards and away from each other, each said body having a plurality of generally parallel, generally flat resilient members extending across the interior of said body and formed of a material selected from the group consisting of natural rubber, synthetic rubber, and polymeric material, each said resilient member having an aperture within the region of its centre, the apertures within each said body being in general alignment.

7. A surface-traversing vehicle according to claim 6, wherein said resilient members are interleaved with other members of greater rigidity than said resilient members.

8. A surface-traversing vehicle according to claim 7, wherein the central apertures of said members of greater rigidity are of slightly larger cross-section than the apertures of said resilient members.

9. A surface-traversing vehicle according to claim 7, wherein said resilient members are supported between spacers which have central apertures which taper in one axial direction.

10. A surface-traversing vehicle which comprises two generally hollow bodies interconnected by means to move the bodies towards and away from each other, each said body having a plurality of generally parallel, generally flat resilient members extending across the interior of said body and formed of a resilient metal, each said resilient member having an aperture within the region of its centre, the apertures within each said body being in general alignment.

11. A surface-traversing vehicle according to claim 10, wherein each said resilient metal member has one or more radial slots extending outwardly from its aperture.

12. A surface-traversing vehicle which comprises two generally hollow bodies interconnected by means to move the bodies towards and away from each other, each said body having a plurality of generally parallel, generally flat resilient members extending across the interior of said body, each said resilient member having an aperture within the region of its centre, the apertures in each body being generally aligned with each other, at least one of said generally hollow bodies further having means to grip the surface being traversed by the vehicle, whereby to enable the direction of traverse to be reversed.

13. A surface-traversing vehicle according to claim 12, having at least one additional said generally hollow body whereby to assist the towing of a power supply line for said vehicle.

14. A surface-traversing vehicle according to claim 12, having additional support in the form of one or more wheels or runners engaging said surface.

15. A surface-traversing vehicle according to claim 12, further having control means to control the operation of the means which moves the bodies towards and away from each other.

* * * * *